US005862651A

United States Patent [19]

Stewart et al.

[11] Patent Number: 5,862,651

[45] Date of Patent: Jan. 26, 1999

[54] FLIGHT BAR GROUPER FOR PACKER

[75] Inventors: Johnny W. Stewart, Bristol, Tenn.; J. Michael Weaver, Madison, Conn.

[73] Assignee: Standard-Knapp, Inc., Portland, Oreg.

[21] Appl. No.: 949,458

[22] Filed: Oct. 14, 1997

[51] Int. Cl.[6] ..... B65B 35/44

[52] U.S. Cl. ..... 53/534; 53/251; 53/537; 53/543; 198/419.3

[58] Field of Search ..... 53/534, 537, 543, 53/251, 448; 198/419.3

[56] References Cited

U.S. PATENT DOCUMENTS

| | | | |
|---|---|---|---|
| 5,009,053 | 4/1991 | Langenbeck et al. | 53/58 |
| 5,241,805 | 9/1993 | Johnson | 198/419.3 |
| 5,560,186 | 10/1996 | Raudat | 53/534 |
| 5,588,284 | 12/1996 | Klover | 53/534 |

*Primary Examiner*—John Sipos
*Assistant Examiner*—Steve Jensen
*Attorney, Agent, or Firm*—McCormick, Paulding & Huber

[57] ABSTRACT

A packer is provided with a continuous flow of side-by-side columns of plastic bottles that move down an inclined ramp and into a load station where groups or slugs of bottles are deposited into trays or cases. An overhead flight bar conveyor provides a gap between each such group and the cases move by line pressure through the load station. Neck ring guides are provided above the flight bar path to control the descent of the bottles into each case. The path of the flight bars assures that each slug or group is closely controlled, initially by the steep entry angle and as a result of the shallow V-shaped path defined by the angularly related linear active runs on the flight bars prior to entry into the load station and by a second active run forming an abrupt V at the entry to the load station and inclined toward the neck ring guides at the same angle defined by the first run.

5 Claims, 3 Drawing Sheets

FLIGHT BAR GROUPER FOR PACKER

CROSS-REFERENCE TO RELATED PATENTS

This application is an improvement to that disclosed in U.S. Pat. Nos. 5,241,805 and 5,560,186 issued to Johnson and Raudat respectively, and assigned to the assignee herein. The disclosure in these patents is incorporated by reference herein.

BACKGROUND OF THE INVENTION

This invention relates generally to improvements in packing plastic bottles into cases which are fed one adjacent the other from below the path of the bottles so as to be continuously mated with groups or slugs of the bottles at a load station.

More specifically, U.S. Pat. No. 5,241,805 shows a system for loading plastic bottles into inline cases or trays where the articles are guided by neck ring guides, and wherein rotating disks are provided with projecting circumferentially spaced lugs that move downwardly between the articles and more particularly between those articles which must be separated to accommodate the end panels of the inline cases. The packer disclosed in this 5,241,805 patent suffers from a disadvantage in that relatively soft plastic bottles of the type filled with any fluid beverages particularly cannot be conveniently accommodated by these rotating disks so as to create the desired spacing between the article rows for accommodating these adjacent end panels of the inline cases.

The more recent U.S. Pat. No. 5,560,186 represents an attempt to cure this problem, but the elimination of the neck ring guide in the packer disclosed in U.S. Pat. No. 5,560,186 has led to inconsistent results with soft plastic product of the general type described in the preceding paragraph. Whereas the '560 patent discloses side guides that are adapted to engage shoulders in the plastic bottles rather than neck ring guides for engaging the necks of the bottles as in the '805 patent. It has been found advantageous to provide a packer capable of utilizing neck ring guides to control the movement of the bottles into the case after leaving the downstream edge of the inclined shelf across which the bottles move into the load station.

One purpose and aim of the present invention, therefore, is to provide a packer of the type which can be fitted either with the separator wheels disclosed in U.S. Pat. No. 5,241,805, or that allows these wheels to be replaced with structure of the present invention, particularly with a structure that provides neck ring guides to control the path of the plastic bottles as they leave the dead plate or shelf and are gradually lowered into the packing case.

Another purpose and aim of the present invention is to provide an overhead flight bar structure that achieves positive control over the slug or group of plastic bottles being loaded into the end-to-end packing cases, and that allows withdrawal of the flight bars along a shallow inclined path that matches the angle of the path taken by the flight bars as they create the spaced slugs or groups of bottles to be loaded.

SUMMARY OF THE INVENTION

The present invention resides in the environment of a plastic bottle packer wherein columns of articles are continuously fed by line pressure down an inclined ramp where they are also supported by neck ring guides so that as they are dropped off a downstream edge of the ramp, further descent of the articles is controlled by the neck ring guides.

The articles must be grouped for entry into the packing cases which are being fed into and through the load station, and in place of the separator disks disclosed in U.S. Pat. No. 5,601,186, the present invention provides for a unique flight bar system that can be provided in a machine of the type shown in the '186 patent, simply by removal of the separator disks and installing a flight bar module of the type to be described. The cross-shaft which normally drives the separator disks is provided in driving engagement with a sprocket associated with each of two flight bar conveyor chains that travel around closed paths defined by this flight bar module structure. More particularly, these flight bars initially move downwardly along a near vertical path between the article rows to be separated, following which initial movement the flight bars travel along a path only slightly inclined with respect to the ramp. The neck ring guides and the ramp are similarly inclined, but the ramp ends well upstream of the neck ring guides which extend through the load station in a direction parallel to the ramp along which the bottles are brought into the load station. The flight bar is moved through an abrupt change of direction at the entry point to the load station. Thus, the neck ring guides extend in the same direction substantially the entire length of the load station. The flight bars after this abrupt change in direction follow on upwardly in climb path oriented at a shallow angle with respect to the direction defined by the neck ring guides. It should be noted that this angle between the neck ring guides and the flight bars through the load station is the same angle as that defined between the flight bars and the neck ring guides upstream of the abrupt change in direction at the entry to the load station.

Whereas U.S. Pat. No. 5,560,186 discloses lugs on the various flight bars used in that particular embodiment, the present invention obviates the need for such lugs and utilizes flight bars alone for controlling the separation of the article groups as they are fed into the packing case at the load station. This advantage is realized as a result of the fact that neck ring guides can be utilized to control the flow of articles into the case at the load station even after the articles leave the inclined ramp. That result is made possible due to the unique V-shaped path for the flight bars defined below the neck ring guides.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE DRAWINGS

In prior U.S. Pat. No. 5,241,805, a conveyor moves articles, such as plastic bottles, in parallel side-by-side columns so that they can be loaded into plastic trays or cases that are fed on a path below that of the bottles on a case conveyor. Both the bottles and the cases are moved continuously by line pressure into the apparatus.

An inclined deadplate or ramp is provided for the bottles so that they move downwardly along a shallow inclined path toward the load station. Lane dividers and side guides are provided to achieve parallel motion for the columns of articles. The ramp has a downstream edge that terminates just short of the load station and slightly above the path taken by the cases as they move into the load station. An important feature of the invention is the inclined neck ring guides which serve to support the plastic bottles as they travel into the load station off the downstream end of the ramp.

In the recently issued U.S. Pat. No. 5,560,186, side guides are provided in lieu of the neck ring guides and the overhead flight bar conveyor follows a path above that of the side guides to achieve separation of the groups of articles in orderly flow of each slug or group of articles into a packing case at the load station.

In the present disclosure, advantage is taken of the use of neck ring guides to guide the bottles moving into the load station. However, instead of these neck ring guides being provided below the path of the flight bar conveyor as in the '186 Patent, the flight bar conveyor system has an abrupt change in direction at the entry to the load station. Thus, the flight bars follow a V-shaped path that is inclined upwardly relative to the neck ring guides so that the plastic bottles can be positively controlled prior to entry into the load station, and during the actual process of the bottles being packed into the cases at the load station.

Figure 1:
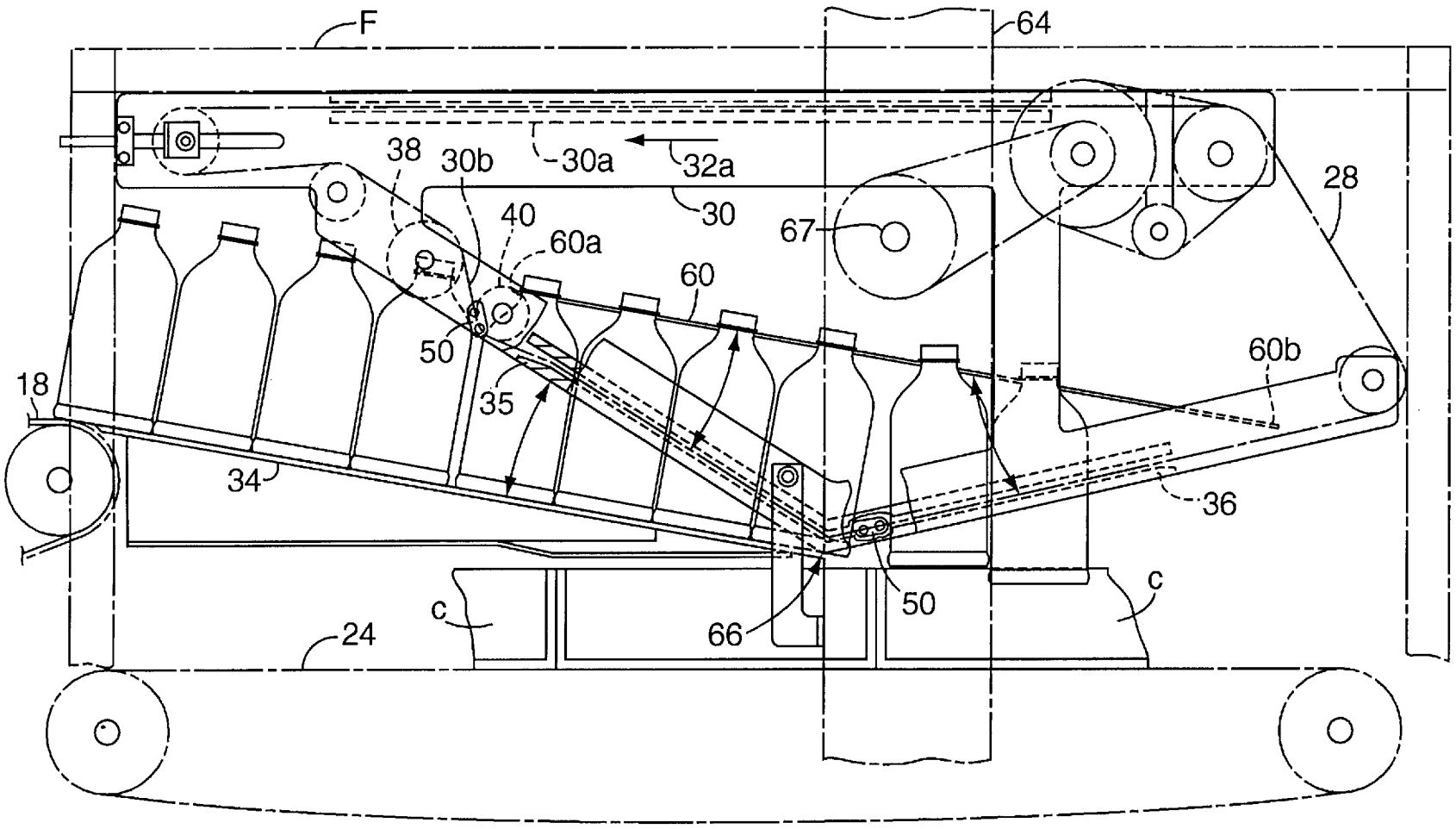
FIG. 1 shows in somewhat schematic fashion and in vertical elevation, only that portion of the packer incorporated by reference from the aforementioned prior patents that comprises the preferred embodiment of the present invention.
Figure 2:
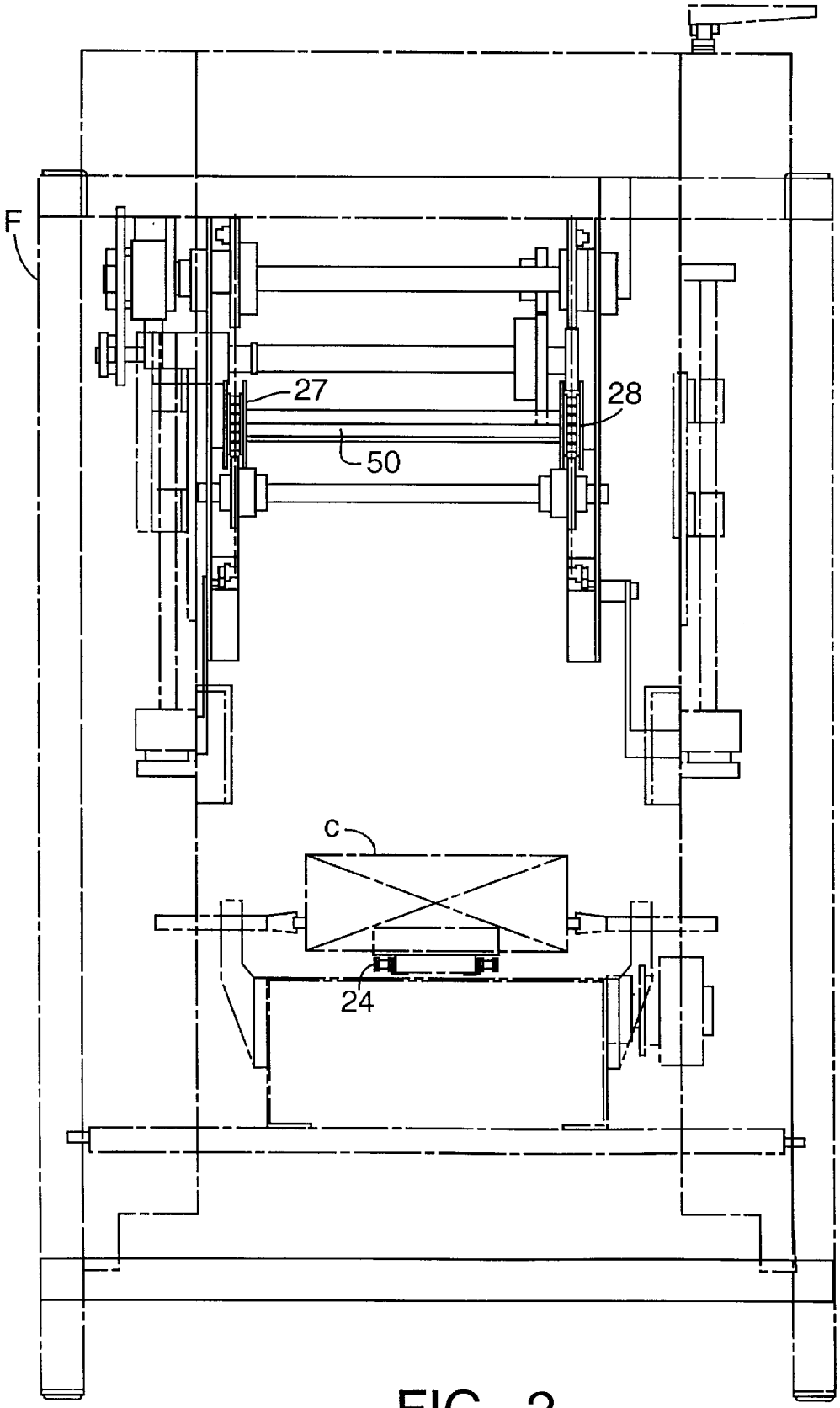
FIG. 2 is an end view of the apparatus illustrated in FIG. 1.
Figure 3:
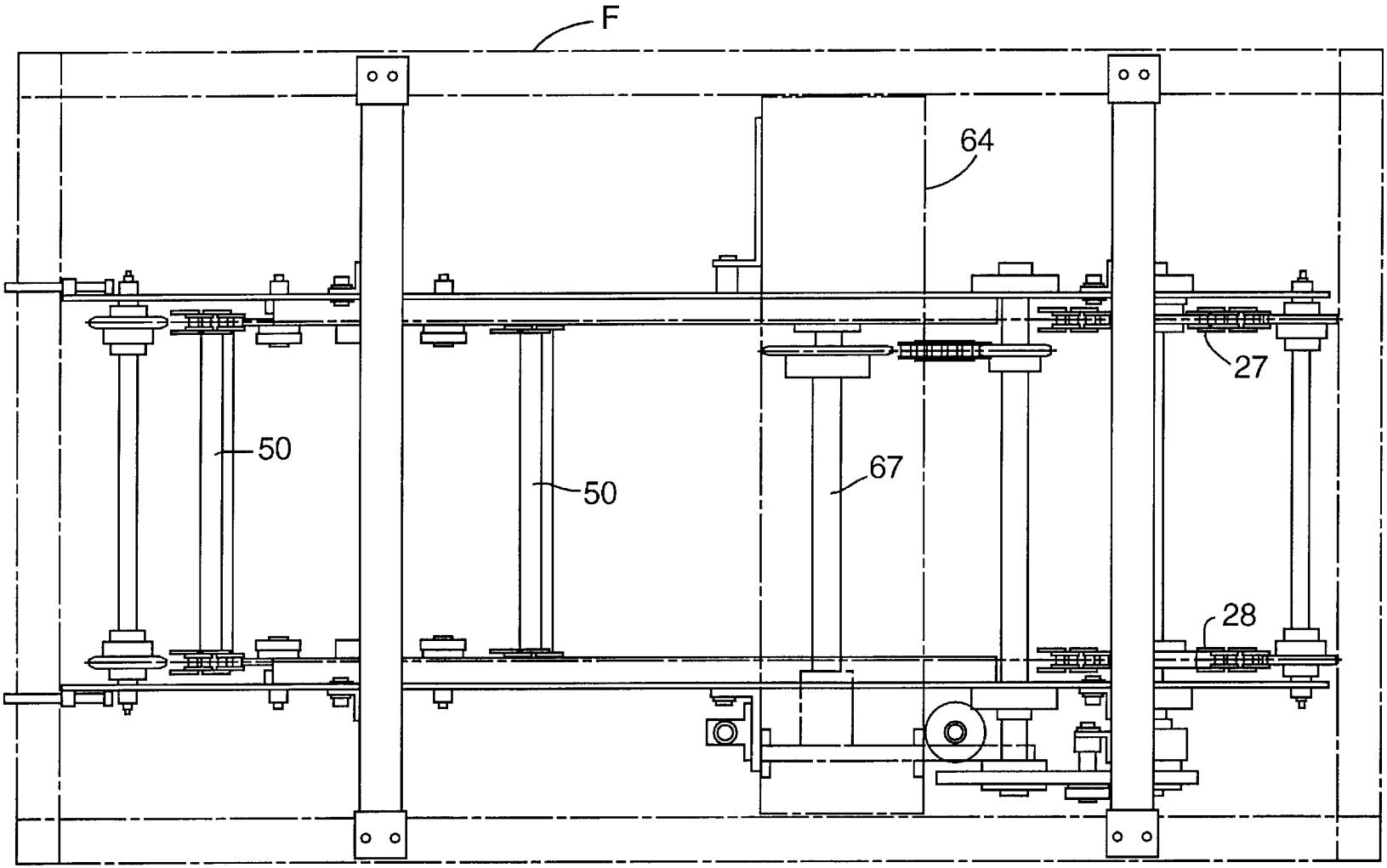
FIG. 3 is a top plan view thereof

Turning now to a more detailed description of FIG. 1, a plastic bottle infeed conveyor 18 is shown providing a supply of bottles under line pressure to the downwardly inclined ramp 34. Fixed side guides (not shown) may be provided for guiding the flow of articles, and lane guides are also provided between the columns of articles on the ramp all in accordance with conventional practice and as described in U.S. Pat. Nos. 5,560,186 and 5,241,805.

A case conveyor 24 is adapted to advance cases c,c in end-to-end relationship through the load station and in a continuous fashion, these cases are loaded with product in a manner to be described. A superstructure 64 is provided in the frame of the machine, the frame being illustrated in phantom lines at F. In accordance with the teaching of U.S. Pat. No. 5,560,186, the superstructure 64 defines a cross-shaft 67 that is driven from the same source as that used to operate the case conveyor 24 and also the bottle conveyor 18. Conventional phase adjusting means is provided for adjusting the motion of an overhead flight bar conveyor system relative to these case conveyors and bottle conveyors.

Flight bar conveyor chains 27 and 28 are entrained around sprockets provided in a vertically adjustably mounted sub-frame 30 so as to define controlled paths for these chains that include a horizontally extending return run 30*a* traveling in the direction indicated by the arrow 32*a,* and an active run in the form of a shallow V-shape that is defined by polymeric guides that define relatively straight inlet and outlet legs of the V as shown generally at 35 and 36 in FIG. 1. An entry run 30*b* for the chains 27 and 28 is provided between the sprockets 38 and 40 so that the chain follows a nearly vertical path as indicated generally at 30*b* in FIG. 1 upstream of this V-shaped active run. The vertical position of the frame 30 is adjusted so as to assure that the flight bars 50 provided between the chains 27 and 28 move quickly into position between adjacent bottles to achieve the desired separation as the chains enter the upstream end of the V-shaped guides 35 and 36. It will be apparent that during this preliminary separation process, to provide a gap between the article groups, the plastic bottles move by line pressure down the ramp 34. However, as the flight bar engages the rearmost row of articles in the group about to be loaded, the necks of these plastic bottles are further guided by neck ring guides 60 that extend from a point just downstream of the entry run 30*b* to a point adjacent the downstream end of the V-shape active run of the chains as indicated generally at 60*b*. The upstream end of the neck ring guides is indicated generally at 60*a* so that the neck rings extend in an upwardly inclined linear fashion from that point to the downstream end 60*b* of the neck ring guides. These angularly related linear paths for the flight bars assure that a constant linear pitch is maintained for closer control of the bottles during the entry phase and at the load station itself.

As so constructed and arranged, the flight bars move in a linear fashion gradually engaging lower and lower points on the plastic bottles themselves. At the apex of the V-shaped active run which is indicated generally at 66 in FIG. 1, the flight bars 50 moves around a rather abrupt corner. The flight bar 50 then moves upwardly relative to the bottles even as the bottles themselves are descending into the case at the load station. This motion serves to further guide the bottles and to control their release into the cases as both the bottles and the case move in a continuous fashion, and at a relatively high rate to package the bottles.

It should be noted that an important feature of the present invention can be attributed to the location of the neck ring guides 60 above the V-shape path of the flight bar conveyor chains and hence, of the flight bars 50 into and through the load station. Another advantage can be attributed to the location for the juncture between the relatively straight legs of the V-shaped path, the location being in close proximity to the downstream end of the ramp 34 along which the bottles travel into the load station. Finally, it should be noted that the angle defined between the legs of the V-shaped path of the flight bars when taken in conjunction with the direction of the bottles along the ramp and of the cases through the load station is a relatively shallow angle preferably in the range of 5°–15° is provided in both regimes. That is, the angle (positive) defined by the neck ring guides and the up stream portion or leg of the V-shaped flight path is at least approximately 10°, and the same angle (negative) is defined between the downstream portion or leg of the V-shaped flight bar path and said direction as defined with the neck ring guides. Preferably, such angle should be at least approximately 10°.

In the claims:

1. In a plastic bottle packer wherein columns of bottles are continuously fed by line pressure onto downwardly inclined neck ring guides such that groups of the bottles are fed by the same line pressure into cases at a load station, the cases being fed end to end on a path through the load station, the improvement comprising:

a superstructure above the path of the bottles moving into and through the load station, and a driven cross shaft in said superstructure for accommodating alternative product grouping mechanisms, a product grouping mechanism in said superstructure and including a frame, parallel flight bar chains supported in said frame, and flight bars provided at predetermined pitch distances on said chains, said frame defining angularly related active runs for said chain, one such active run being oriented linearly at a shallow positive angle downwardly relative said neck ring guides, and the other active run forming a V with the first active run and oriented at a negative shallow angle upwardly relative said neck ring guides, said neck ring guides extending through the load station, said shallow angles being equal to one another, and said angularly related active runs meeting at a juncture defining said V at the entry of the load station.

2. The combination of claim 1, wherein an inclined ramp is provided parallel to the neck ring guides, said ramp having a downstream end provided at said load station entry.

3. The combination of claim 2, wherein said shallow angle is in the range between 5°–15°.

4. The combination of claim 2, wherein said shallow angle is approximately 10°.

5. The combination of claim 1, wherein said neck ring guides are provided above both said active runs of said flight bars.

* * * * *